US005613393A

United States Patent [19]

Bessey

[11] Patent Number: 5,613,393

[45] Date of Patent: Mar. 25, 1997

[54] METAL EXTRUSION PROCESS AND EXTRUSION PRESS

[75] Inventor: Guy Bessey, Auvers Sur Oise, France

[73] Assignee: Clecim, Cergy Pontoise, France

[21] Appl. No.: 238,869

[22] Filed: May 6, 1994

[30] Foreign Application Priority Data

May 6, 1993 [FR] France ..... 9305463

[51] Int. Cl.[6] ..... B21C 27/00

[52] U.S. Cl. ..... 72/272

[58] Field of Search ..... 72/253.1, 271, 72/272

[56] References Cited

U.S. PATENT DOCUMENTS 1,935,286 11/1933 Born ..... 72/272

2,822,087 2/1958 Lorant ..... 72/272

5,445,004 8/1995 Nannini et al. ..... 72/272

FOREIGN PATENT DOCUMENTS 531612 3/1993 European Pat. Off. .

*Primary Examiner*—Lowell A. Larson

*Attorney, Agent, or Firm*—Pollock, Vande Sande & Priddy

[57] ABSTRACT

A process for extrusion of a metal billet placed in a container delimiting a housing for the billet. One end of the container is closed by a closing bottom and the other end by a dummy block. Before extrusion, the billet is pre-compressed in order to apply it against the inner face of the housing. At the start of the pre-compression, a limited play is maintained between the closing bottom and the corresponding end of the container, preventing the container from approaching the closing bottom during pre-compression so as to allow evacuation of air contained between the billet and the inner housing face during expansion of the billet.

6 Claims, 1 Drawing Sheet

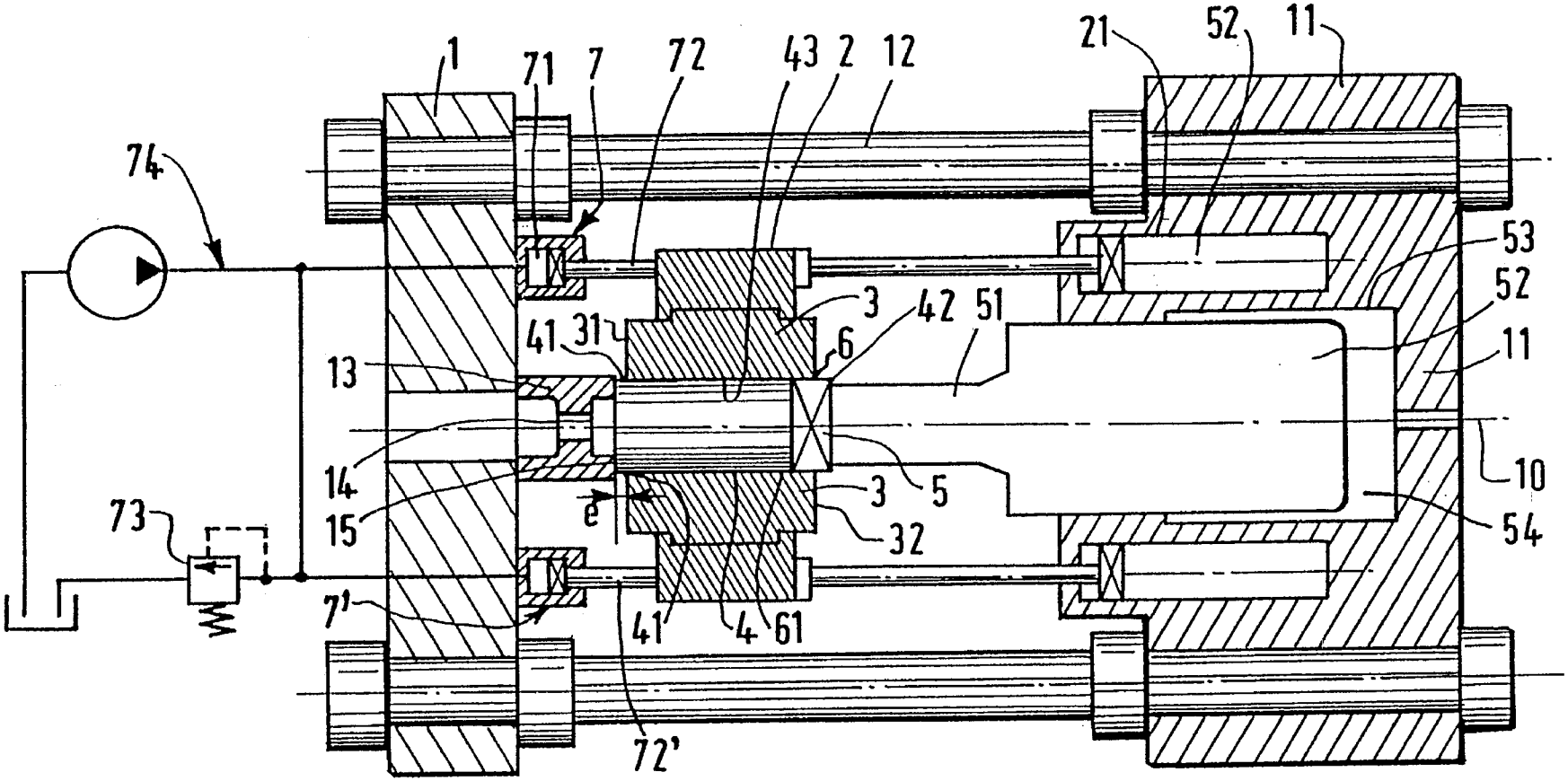
53
52
11
10
54
11
52
21
51
42
5
12
3
6
3
32
2
43
61
4
72
41
72'
7
31
41
e
71
1
13
14
15
7'
74
73

METAL EXTRUSION PROCESS AND EXTRUSION PRESS

FIELD OF THE INVENTION

The invention relates to a process for extruding a metal billet in an extrusion press and an extrusion press for carrying this process.

BACKGROUND INFORMATION

It is known that, in order to produce bars, wires or other metal shaped pieces, particularly in non-ferrous metal, a metal billet is generally extruded from an extrusion press comprising a container delimiting a tubular housing centered on an extrusion axis, closed at its ends by two closing pieces, and into which a metal billet to be extruded is placed. One of the crosspieces has a die. The assembly is placed in a frame comprising two fixed crosspieces held apart from each other by tie rods. One of the closing pieces comprises a block of the same diameter as the housing, placed at the end of the ram. The block is introduced into the housing by a main extrusion jack which bears on a fixed crosspiece, and approaches the other closing piece bearing on the other crosspiece. The metal compressed between the two closing pieces is extruded through the die in the form of a shaped piece having the same section.

In the process known as "forward extrusion", the container is fixed and bears directly on one of the fixed crosspieces, the die being carried by the closing piece. The ram carrying the block constituting the other closing piece is driven by the main extrusion jack which makes the block penetrate into the housing of the container.

In the process known as "backward extrusion", the die is mounted on a block of the same diameter as that of the housing of the container, and placed at the end of a tubular ram which bears on one of the fixed crosspieces. The opposite end of the container is closed by a bottom, the assembly being mounted on a movable crosspiece driven by the main extrusion jack, such that the housing slides onto the block, causing the metal billet contained inside the housing to be extruded through the die, the extruded shaped piece being expelled through the tubular ram.

Metal billets are produced from long blooms which are cut up into lengths slightly shorter than the length of the housing of the container. The transversal section of each bloom is also slightly smaller than that of the housing of the container so as provide the clearance needed between the inner face of the housing and the outer face of each billet to introduce the billet into the housing.

This is why actual extrusion is preceded by a precompression operation during which the billet, as it starts to be crushed by the two closing pieces moving towards each other, slightly expands and is fully applied against the inner face of the housing of the container.

The air in the original clearance between the billet and inner wall of the housing is thus highly compressed and must be expelled by a "degassing" operation before extrusion.

In forward extrusion processes, this degassing following precompression is normally achieved by commanding a slight backward movement of the container with the ram to allow the container to detach from the bottom carrying the die, thereby allowing the compressed air in the housing to escape. To this end, the press is provided with auxiliary jacks for isolated maneuvers of the container, and jacks for pushing back the main extrusion jack, which is normally a single-acting jack.

These operations call for the reversal of hydraulic commands by acting on pumps, valves or other elements, with relatively long response times. This results in dead time that reduces the productivity of the press and which up to now has seemed unavoidable since inadequate degassing can lead to defects such as bubbles or blisters in the extruded product and even introduce a risk of explosion during extrusion.

SUMMARY OF THE INVENTION

The invention overcomes these drawbacks thanks to a process which makes it possible to virtually avoid dead time which, until now, has been necessary for degassing and, as a result, increase the productivity of the press. Indeed, recent development of the technique allows the press to be used as continuously as possible without neglecting any dead time, not even very short periods.

The invention is intended more especially for forward extrusion presses, but can also find applications in backward extrusion presses.

The invention applies to the extrusion of a metal billet in an extrusion press made up of a container having a tubular housing centered on an extrusion axis and in which the billet is placed, the container bearing, during extrusion, on a first cross piece, two pieces for closing the two ends of the housing, respectively, a bottom piece carried by the first crosspiece against which the container bears, and a dummy block whose cross-section is substantially identical to that of the housing, the dummy block being mounted on the end of an extended ram and able to penetrate into the housing by an axial sliding movement, a die centered on the extrusion axis and which is mounted on one of the closing pieces, means which bear on a second crosspiece to control the coming together of the closing pieces in order to extrude the billet by extrusion in the die, the extrusion operation being preceded by a phase for precompressing the billet between the block and the bottom until the billet is fully applied against the wall of the housing.

According to the invention, the container, at least during most of the precompression phase, is prevented from pressing against the bottom, a small clearance being maintained between the bottom and the corresponding end of the container so as to allow the air contained in the housing to be progressively expelled during precompression of the billet up to the time the billet is fully applied against the wall of the housing.

To maintain the clearance, it is preferable to interpose a spacing device between the container and the first crosspiece, that is able to exert a calibrated retaining force on the container directed in the direction opposite that in which the block penetrates into the housing. The value of the force is limited such that the spacing device yields under the pressure of the container, allowing the clearance to be removed and the bottom to close when the pressure exerted on the billet is sufficient to join together the container and billet.

In a particularly advantageous embodiment, degassing is completed by relaxing the hydraulic pressure in the extrusion control means for a brief moment at the end of the precompression phase, thereby causing the billet to move slightly backwards with the container and the bottom to reopen under the action of the spacing device and instantaneously create a clearance allowing residual air to escape.

The invention also covers an improved extrusion press for carrying the process into practice, comprising means for retaining the container, interposed between the first crosspiece and the corresponding end of the container and which extend over a sufficient distance to allow sufficient clearance to exist between the end of the container and the closing bottom, so that the air contained between the billet and inner face of the housing can be expelled.

According to a preferred embodiment, the retaining means comprise at least two jacks arranged on either side of the extrusion axis, bearing on one side on the first crosspiece and on the other side on the corresponding end of the container.

Advantageously, the retaining jacks are associated with means for releasing the pressure when the pressure exceeds a limit value.

BRIEF DESCRIPTION OF THE DRAWING

The invention will be better understood from the following description of a particular embodiment of the invention given by way of example and to be read in conjunction with the attached drawing.

The single figure shows a schematic longitudinal cross-section of an extrusion press comprising two fixed crosspieces 1, 11 held a constant distance apart from each other by crosspiece 12, and between which a movable crosspiece 2 is mounted in sliding fashion carrying a container 3 in which a cylindrical housing 4 is provided centered on an extrusion axis 10.

Container 3 can move axially with the movable crosspiece 2 under the action of auxiliary jacks 21 bearing on fixed crosspiece 11. Container 3 can thus be pressed against a piece 13 forming a bottom for closing corresponding end 41 of housing 4, and on which a die 14 is mounted centered on extrusion axis 10.

On the opposite face 32 of container 3, end 42 of housing 4 is closed by a dummy block 5 mounted at the end of an elongated ram 51 fixed on piston 52 of a main extrusion jack whose body 53 is provided in fixed crosspiece 11.

DESCRIPTION OF PREFERRED EMBODIMENTS

The above arrangements are all conventional, and can be adapted for other versions or special arrangements allowing specific operations to be carried out.

First of all, a metal billet 6, slightly smaller in diameter than housing 4, is placed inside the housing. The container is then advanced by auxiliary jacks 21 towards die carrier part 13 which closes corresponding end 41 of housing 4. Ram 51 is pushed by main jack piston 52, or alternatively under the action of auxiliary jacks (not shown), such that dummy block 5, whose cross-section is substantially identical to that of housing 4, penetrates into corresponding end 42 of housing 4, and bears against the corresponding face of billet 6 which in turn is refined on the bottom.

Before extrusion actually takes place, simple precompression is performed by advancing block 5 under the action of main jack piston 52. Billet 6 expands and its outer face 61 presses against inner face 43 of housing 4.

Generally, during this operation, front face 31 of container 3 is pressed against closing bottom 13 and the air contained in the clearance originally existing between billet 6 and housing 4 is compressed by the expansion of billet 6. This compressed air must be expelled after the precompression phase. Up until now, this degassing operation has been performed by drawing back the container and moveable crosspiece 2 under the action of auxiliary jacks 21.

Such a maneuver, which takes quite some time, is avoided thanks to the arrangements of the invention. Indeed, during the precompression phase, face 31 of container 13 is prevented from pressing against die carrier part 13 by means of jacks 7 which interpose between fixed crosspiece 1 and container 3 or movable crosspiece 2. In the example shown, two jacks 7, 7' are used, the body 71 being fixed to fixed crosspiece 1 and the rod 72 pressing against moveable crosspiece 2.

The length of rods 72 is that, in the extended position of jacks 7, 7', only a small clearance (e) exists between front face 31 of container 3 and the corresponding face 15 of die carrier piece 13.

The operation of the extrusion press according to the invention will now be described.

Billet 6 is first loaded into housing 4 of container 3 by conventional means. Movable crosspiece 2 is then advanced by auxiliary jacks 21 until it comes to bear against jacks 7, 7' positioned in their fully extended position. In this position, front face 31 of the container is located a small distance (e) from die carrier piece 13.

Main jack piston 52 then moves dummy block 5 forwards, causing face 60 of billet 6 to press against die carrier bottom 13 and the billet to expand. The air contained between inner face 43 of housing 4 and outer face 61 of the billet progressively escapes through the clearance (e) as billet 6 expands.

From a certain application pressure of block 5 against billet 6, outer face 61 of the billet is fully applied against inner face 43 of housing 4. As a result, container 3 rigidly locks with billet 6 due to friction. Container 3 also tends to be driven axially forwards by block 5, but its movement is impeded by jacks 7, 7'. Clearance (e)is therefore maintained during most of the precompression phase.

The tendency of container 3 to advance depends on the friction between container 3 and billet 6, and therefore on the thrust applied on the billet by dummy block 5.

However, the metal thus compressed must not have a tendency to escape via the peripheral clearance (e). For this reason, the pressure in chamber 71 of each jack 7, 7' is calibrated so as to resist the advancement of the container only up to a certain limit of pressure applied on the billet, and beyond which the metal could infiltrate into clearance (e). Beyond this limit, the friction between billet 6 and inner face 43 of housing 4 is such that container 3 is sufficiently locked with dummy block 5 to push back jacks 7, 7'; which give way under the pressure applied and allow container 3 to move forward until its front face 31 abuts against corresponding face 15 of die carrier piece 13 and completely closes end 41 of housing 4.

The actual extrusion operation can now start.

However, there may be some doubt as to whether all the air has been expelled from the container and whether a certain quantity of air still remains between billet and housing. For this reason, in order to complete degassing, one can, as a safety measure, command the release of the hydraulic pressure on chamber 54 of jack 52 for a brief moment. Since the pressure of jack piston 52 is applied on container 3 via billet 6, this hydraulic release in chamber 54 allows jacks 7,7', which are under pressure, to slightly push back container 3 and block 5 with ram 51. A small clearance reappears between front face 31 of container 3 and die carrier piece 13, through which any highly compressed air remaining inside the housing is able to escape.

Most of the degassing therefore takes place progressively during the time taken up by the unavoidable precompression phase, i.e., in masked time.

The second degassing stage, which may not always be indispensable, is carried out automatically and quasi-instantaneously under the action of jacks 7,7', held under pressure, the moment a command is given to release the pressure in main jack 54. Here lies an essential advantage compared to arrangements used to date, in which air is allowed to compress in the container during the precompression stage, with degassing being effected by commanding the withdrawal of the container by means of auxiliary jacks 21 or other jacks for pushing back the main jack (not shown). Such a withdrawal calls for different hydraulic maneuvers which are obviated by the process of the invention, therefore making it possible to improve productivity by avoiding the corresponding dead time.

The inventive process can also be carried out by a very simple device, which only comprises two jacks 7,7' supplied from an hydraulic circuit 74, under a measure which is limited, for example, via a calibrated valve 73 whose adjustment can be determined according to the characteristics of the press, the type of metal and the pressure starting from which the metal can escape through the clearance (e) left between container 3 and die carrier 13.

A the invention is particularly applicable to a forward extrusion press of the type described, its use would also be of interest in the case of a backward extrusion press. Similar means could be employed to implement the same process.

Indeed, in a backward extrusion press, the container is movable and slips over the ram, which is fixed. The end of the ram carries a block on which the die is mounted and which penetrates into the front end of the housing. In this case, the main extrusion jack drives a movable crosspiece which carries a bottom for closing the container and bears on the container to push it toward the fixed crosspiece carrying the ram, the extruded product being evacuated through an orifice located on the axis of the ram.

The jacks for retaining the container are placed on the movable crosspiece and bear against the rear face of the container to prevent the rear face from pressing against the movable crosspiece, while leaving a clearance between the container and closing bottom, allowing air to be progressively expelled as precompression proceeds until such time as the pressure exerted by the billet against the inner face of the housing is such that the container is sufficiently locked with it for the retaining jacks to give way and close up the clearance.

What is claimed:

1. A process for extruding a metal billet in an extrusion press comprising:

(a) two fixed crosspieces separated by a constant distance;

(b) a container having a tubular housing for receiving a billet, said housing having first and second ends and being centered on an extrusion axis, said container bearing, during extrusion, on a first crosspiece;

(c) two pieces for closing said first and second ends of said housing, respectively, a bottom piece carried by said first crosspiece on which said container bears, and a dummy block having a cross-section substantially identical to a cross-section of said housing, said block being mounted on an end of an extended ram and penetrating into said housing by an axial sliding movement;

(d) a die centered on an extrusion axis and being mounted on one of said closing pieces;

(e) auxiliary jacks for axially moving said container between said crosspieces; and (f) a main jack bearing against a second crosspiece to control pressing of said billet between said dummy block and an end face of said bottom piece in order to extrude said billet through said die;

(g) extrusion being preceded by precompression of said billet between said dummy block and an end face of said bottom piece until said billet is fully applied to an inner face of said housing;

said process comprising the step of preventing said container, at least during most of said precompression, from pressing against said bottom piece, by maintaining a small clearance between said bottom piece and a corresponding end of said container, so as to allow air contained in said housing to be progressively expelled during precompression of said billet until said billet is fully applied against said inner face of said housing.

2. The process according to claim 1, wherein said clearance is maintained between said container and said bottom piece by interposing a spacing device between a front face of said container and said first crosspiece carrying said bottom piece and which is able to exert a calibrated retaining force on said container in a direction opposite to that in which said dummy block penetrates into said housing, a value of said force being limited such that said spacing device yields under the pressure applied by said container rigidly locked with said billet and allowing said container to advance and said end face of said bottom piece to abut against a front face of said container to close a corresponding end of said housing when said pressure exceeds a calibration limit value.

3. The process of claim 2, wherein said clearance is maintained by at least two jacks each having a chamber in which a pressure is applied for positioning said jacks in fully extended position and retaining said container up to a calibrated value of said pressure in said chamber corresponding to a limit value of the pressure applied on said billet beyond which metal would tend to pass into said clearance between said end face of said bottom piece and the face of said container.

4. The process of any one of claims 1 to 3, wherein, after said container has been applied to said bottom piece, hydraulic pressure in said main jack is released for a brief moment, bringing about a slight withdrawal of said billet with said container and instantaneous reopening of a clearance between said end face of said bottom piece and front end of said housing under action of said spacing device, allowing escape of any air trapped inside said container when said bottom piece was closed.

5. Process for extruding a metal billet in an extrusion press comprising:

(a) first and second fixed crosspieces separated by a constant distance;

(b) a container having a cylindrical housing centered on an extrusion axis, and having two ends;

(c) auxiliary jacks for axially moving said container between said crosspieces:

(d) a dummy block having a cross-section substantially identical to a cross-section of said housing for closing a first end of said housing, said block being mounted on an end of a ram and penetrating into said housing under the action of a main jack bearing on said first crosspiece;

(e) a bottom piece carrying a die centered on said extrusion axis and bearing on said second crosspiece, said bottom piece having an end face abutting against a front face of said container for closing a second end of said housing;

(f) retaining jacks, each having a chamber and a rod, said retaining jacks being interposed between said second crosspiece and said container;

said process comprising the steps of:

(g) placing a metal billet inside said housing of said container;

(h) placing said retaining jacks in extended position;

(i) advancing said container by means of said auxiliary jacks towards said bottom piece, said container being prevented from pressing against said bottom piece by the rods of said retaining jacks, said rods having a length such that a clearance exists between said front face of said container and an end face of said bottom piece, in an advanced position of said container;

(j) pushing said ram such that said dummy block penetrates into said first end of said housing and abuts against a corresponding face of said billet, the other face bearing against said end face of said bottom piece;

(k) further advancing said ram and said dummy block under the action of said end face of said bottom piece, air between an inner face of said housing and an outer face of said billet progressively escaping through said clearance as said billet expands, said container being retained by said retaining jacks by a pressure maintained in said chamber of said retaining jacks:

(l) maintaining up to a calibrated limit value said pressure in said chambers of said retaining jacks;

(m) allowing said container to move forward by pushing back said jack until said front face of said container abuts against said end face of said bottom piece for closing the corresponding end of said housing; and (n) starting an extrusion operation.

6. Press for extruding a metal billet comprising (a) first and second fixed crosspieces separated by a constant distance;

(b) container having a cylindrical housing centered on an extrusion axis, said container having first and second ends and being axially movable between said crosspieces;

(c) auxiliary jacks for advancing said container toward a bottom piece;

(d) a dummy block having a cross-section substantially identical to a cross-section of said housing for closing a first end of said housing, said dummy block being mounted on an end of a ram and penetrating into said housing under the action of a main jack bearing on said first crosspiece:

(e) a bottom piece carrying a die centered on said extrusion axis and bearing on said second crosspiece, said bottom piece having an end face abutting against a front face of said container for closing said second end of said housing in an advanced position of said container;

(f) retaining jacks, each having a chamber and a rod, said retaining jacks being interposed between said second crosspiece and said container and having an extended position for which a clearance is maintained between said front face of said container and said end face of said bottom piece; and (g) an hydraulic circuit for supplying said chambers of said retaining jacks and placing them in extended position, said hydraulic circuit comprising a calibrated valve for limiting pressure in said chambers to a calibrated value.

* * * * *